United States Patent [19]

Laughlin

[11] 4,229,912

[45] Oct. 28, 1980

[54] TAKE-APART CONVERTIBLE ROTARY TOOL

[76] Inventor: William F. Laughlin, 133 Division St., St. Charles, Ill. 60174

[21] Appl. No.: 910,210

[22] Filed: May 30, 1978

[51] Int. Cl.[3] ..... B24D 13/04

[52] U.S. Cl. ..... 51/335; 51/336; 15/198

[58] Field of Search ..... 15/198, 200; 29/81 H; 51/322, 334, 335, 336, 337, 361, 168, 207; 125/5

[56] References Cited

U.S. PATENT DOCUMENTS

| | | | |
|---|---|---|---|
| 394,747 | 12/1888 | Wolcott | 51/335 |
| 1,897,971 | 2/1933 | Johnston | 51/337 |
| 2,452,409 | 10/1948 | Wickman | 51/335 |
| 2,522,920 | 9/1950 | Baltes | 51/335 |
| 2,625,774 | 1/1953 | Tenny | 51/335 |
| 2,726,493 | 12/1955 | Young et al. | 51/168 |
| 2,767,526 | 10/1956 | Moran | 51/335 |
| 2,842,902 | 7/1958 | Miller et al. | 51/337 |
| 2,854,798 | 10/1958 | Haven | 51/335 |
| 3,132,452 | 5/1964 | Block | 51/335 |
| 3,958,294 | 5/1976 | Thompson | 15/198 |
| 3,986,302 | 10/1976 | Biardi | 51/168 |

FOREIGN PATENT DOCUMENTS

| | | | |
|---|---|---|---|
| 538416 | 10/1931 | Fed. Rep. of Germany | 15/198 |
| 223718 | 10/1924 | United Kingdom | 15/198 |

*Primary Examiner*—Gary L. Smith
*Assistant Examiner*—Robert P. Olszewski
*Attorney, Agent, or Firm*—Hill, Van Santen, Steadman, Chiara & Simpson

[57] ABSTRACT

A pair of spaced coaxial body disks of substantial diameter are spaced apart by at least the length of an axial hub fixedly mounted on one of the disks and projecting toward the other disk, the hub having a threaded bore opening through its end adjacent to the other disk so that a threaded shank portion of an arbor extending through the other disk and threaded into the bore retains the disks in assembled orientation together with a plurality of working element supporting shafts fixedly mounted on the one disk at spaced intervals and having free ends received in socket holes in the other disk. Working elements comprising stripper flails, emery strips, polishing strips, or the like are adapted to be mounted on the supporting shafts. Sanding or polishing material carried by a hollow core received about the hub may have a plurality of sanding or polishing strips projectable from the perimeter of the assembly through spaces between the shafts for sanding or polishing purposes in rotary operation of the tool.

8 Claims, 6 Drawing Figures

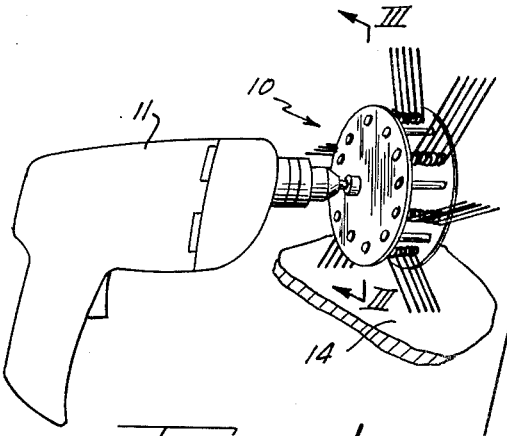
Fig. 1
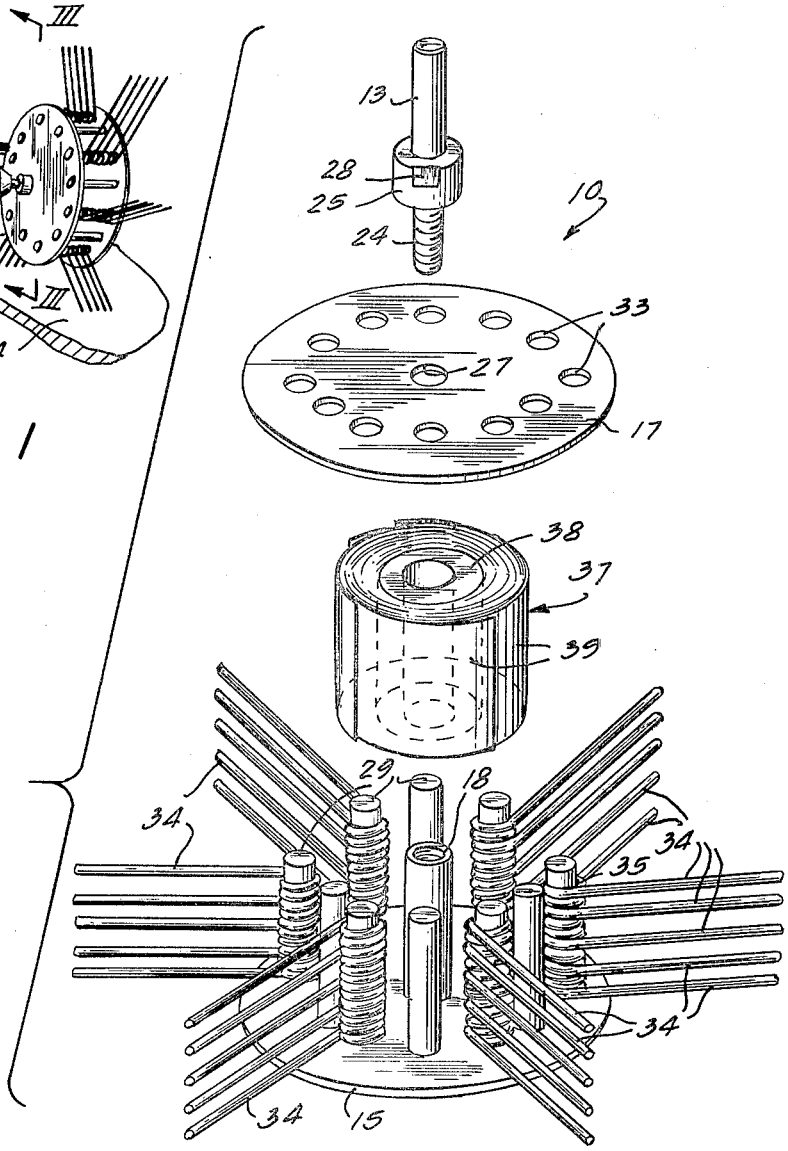
Fig. 2
Fig. 3
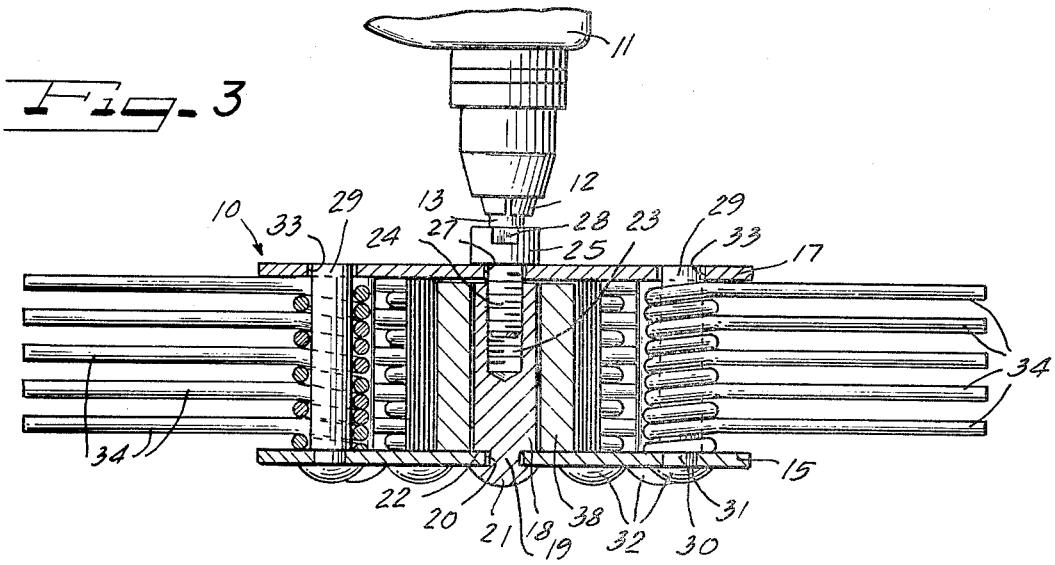

TAKE-APART CONVERTIBLE ROTARY TOOL

This invention relates to a take-apart convertible rotary tool, and is more particularly concerned with a tool of the type which is adapted to be operated by a hand held rotary driving power unit which has a chuck releasably engageable with an arbor on the rotary tool.

Rotary tools for surface cleaning by means of pivoted flails or fingers are well known. By way of example, reference is made to U.S. Pat. No. 3,958,294 showing such a tool. Although not shown in that patent, such tools are available with arbors for engagement by the chuck of a power unit. Commonly, tools of this type are constructed as inseparable units. That is the body parts consisting of spaced disks are riveted or otherwise permanently secured to or by the shafts on which the flails are mounted. After performing the rough surface cleaning or descaling by use of the flail carrying tool, another tool must be employed for sanding or grinding or polishing the surface. For example, when it is desired to repaint a surface or to descale a corroded surface and prepare the surface for adequate retention of a fresh coat of paint, not only must the original paint or such parts of the original coat as remained on the surface, and all scale or rust be removed, but the surface should be sanded to be sure that the surface is thoroughly free from any residual paint or rust or other solid interferent to thorough adherence of a fresh coat of paint. Therefore, after use of the flail type rotary cleaning or scraping tool, a second tool has heretofore been required to do the sanding.

I propose to accomplish not only the preliminary cleaning of a surface but also the final or finish sanding, cleaning or buffing of the surface by means of the same take-apart convertible rotary tool.

While take-apart tools have heretofore been proposed, such as represented in U.S. Pat. Nos. 394,747 and 1,897,971, such proposed tools are for the single purpose of finishing and do not have a dual or convertible capacity. In addition they embody complex or expensive structure in the tool assembly.

An important object of the present invention is to provide a new and improved take-apart convertible rotary tool for working a surface by means of peripherally extending yieldable working elements and which will overcome disadvantages, drawbacks, inefficiencies, shortcomings and problems inherent in prior tools of this general type.

In an embodiment of the invention, a take-apart convertible rotary tool for working a surface by means of peripherally extending yieldable working elements, comprises a pair of spaced coaxial body disks of substantial diameter; an axial hub of substantially smaller diameter than the disks fixedly mounted on one of said disks and projecting toward the other disk, said hub having a threaded bore opening through its end adjacent to said other disk said other disk having a central opening slightly larger than said threaded bore but smaller than the diameter of said adjacent end of said hub; an arbor adapted to be engaged by a power tool chuck and having a threaded shank projecting axially from a clamping shoulder and engaging through said central hole in said other disk into threaded engagement in said threaded bore whereby said shoulder clamps said other disk toward said adjacent end of the hub, peripheral wrench face means adjacent to said shoulder to facilitate threaded manipulation of the arbor for securing the parts of the tool together or for separating the parts of the tool; a plurality of working element supporting shafts fixedly mounted on said one disk at spaced intervals relative to each other and relative to said hub and projecting toward said other disk, said shafts being longer than said hub; and said other disk having socket holes therein complementary in diameter to said shafts and having free ends of said shafts extending thereinto for mutual cooperation of said shafts and said other disk whereby the shafts maintain said other disk corotative with said one disk and said other disk maintains said free ends of said shafts in stable relation in the assembly.

Different types of peripherally extending yieldable working elements are adapted to be mounted on the supporting shafts of the tool by removing said one disk to expose the supporting shaft. A multi-strip roll of sanding material such as sandpaper or emery cloth is adapted to be mounted in the tool about the axial hub for selective projection of the sanding strips from the periphery of the tool either between flail-like finger working elements mounted on the supporting shafts or merely between the supporting shafts in the absence of the finger elements.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

FIG. 1 is a perspective view of a tool embodying the invention demonstrating its use as attached to a hand held power unit.

FIG. 2 is an exploded isometric view of the tool.

FIG. 3 is an enlarged sectional detail view taken substantially along the line III—III of FIG. 1.

Figure 4:
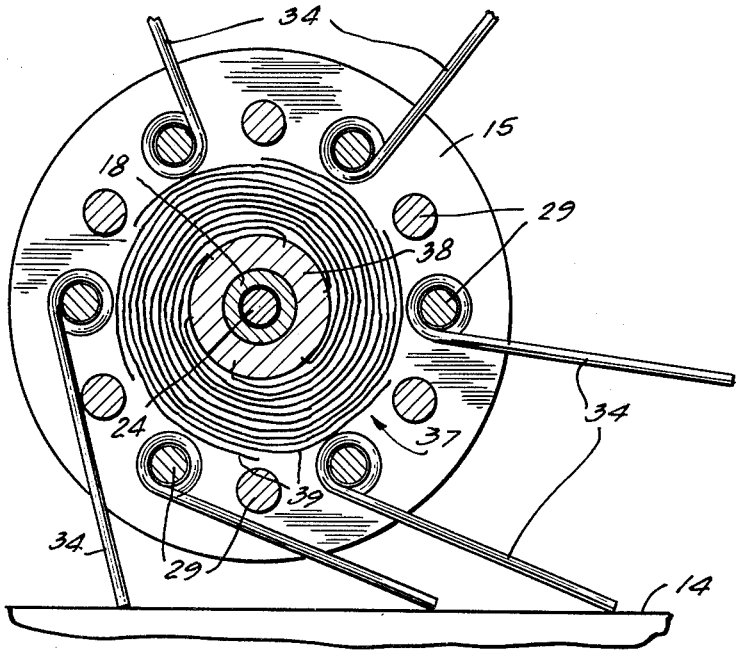
FIG. 4 is a sectional detail view taken substantially along the line IV—IV of FIG. 3 and showing sanding strips wound on a core within the tool.

On reference to FIGS. 1 and 3, a tool 10 embodying the principles of the present invention is depicted as mounted on a hand held power unit 11 of any preferred form and equipped with a chuck 12 for releasably engaging a combination fastener and arbor 13 carried by the tool 10 and by which means the tool 10 is adapted to be rotatably driven relative to a surface 14 to be worked.

A special virtue of the tool 10 is its simple take-apart construction facilitating convertibility. To this end, referring especially to FIGS. 2 and 3, the tool 10 comprises a pair of spaced coaxial body disks 15 and 17 of substantial diameter. As shown the disks 15 and 17 are of the same diameter, although one or the other of the disks may be of larger diameter if preferred for any reason. An axial hub 18 of substantially smaller diameter than the disks is fixedly mounted on one of the disks, herein the disk 15 and projects toward the other disk 17. Fixed mounting of the hub 18 on the disk 15 may be effected in any preferred manner but is preferably permanent so that the hub will not separate from the disk 15. This can be conveniently accomplished by providing the hub 18 with a reduced diameter extension 19 on one end which projects through a complementary clearance hole 20 centrally in the disk 15, and with the outer end of the extension 19 peened over to form a rivet head 21, a shoulder 22 facing axially on the hub 18 about the fastener extension 19 being thus drawn tightly against the disk 15.

At its opposite, free end which is adjacent to the disk 17, the hub 18 has a threaded bore 23 opening axially therethrough. The arbor 13 has a threaded shank 24 projecting axially from a clamping shoulder collar 25 and engaging through a central hole 27 in the disk 17 into threaded engagement in the threaded bore 23, whereby the shoulder 25 clamps the disk 17 toward the adjacent end of the hub 18. The shoulder collar 25 is preferably of some length between the clutch engageable portion of the arbor 13 and the threaded shank 24 and is desirably provided with wrench faces 28 for manipulation of the combination fastener and arbor relative to the body disk 17 and the hub 18. Preferably the arbor 13 is made of a metal or other suitably rigid material.

Carried fixedly by the body disk 15 is a plurality of working element supporting shafts 29, in this instance twelve shafts, equidistantly spaced from one another in a circle and in spaced relation about the hub 18. Each of the shafts 29 has a reduced diameter base end portion 30 which extends through a complementary hole 31 in the disk 15, and a rivet head 32 is peened over and secures the shaft 29 in place on the disk 15. Each of the shafts 29 is longer than the hub 18 sufficiently so that the free ends of the shafts 29 are received freely slidably and freely releasably and without affixation in complementary socket holes 33 in the disk 17. Thereby the disk 17 and the shafts 29 are in mutual cooperation, the shafts 29 maintaining the disk 17 corotative with the disk 15, and the disk 17 maintaining the free ends of the shafts in stable relation in the assembly against any unusual torque or bending strains. If desired the disks 15 and 17 as well as the hub 18 and shafts 29 may be fashioned from a suitable plastic, such as a polycarbonate resin and one of the disks, e.g., 15, hub 18 and the shafts 29 may be molded as a single piece for sake of manufacturing convenience and economy.

Each of the shafts, or any selected ones of the shafts illustrated as six of them or each alternate one of the shafts, may be equipped with yieldable working elements 34 which, as shown in FIGS. 2–5, may be in the form of relatively stiff wire fingers, of any suitable gauge, as for coarse or fine work. Each of the elements 34 has a loop 35 bent at one end and of generally spiral form so that it not only serves as a connection through which the associated shafts 29 extends, but also as a spacer for the next subjacent finger 34. In the illustrated embodiment, five of the working element fingers 34 are shown on each associated shaft 29 and they are of a length to extend a substantial distance generally radially from the perimeter of the tool body as defined by the perimeters of the disks 15 and 17. The construction and relationship of the fingers 34 is such that in the rotation of the tool 10 when powered by the power unit 11, the working elements 34 are adapted to strike the surface 14 with their free ends and act upon the surface in a scraping cleaning fashion.

Figure 5:
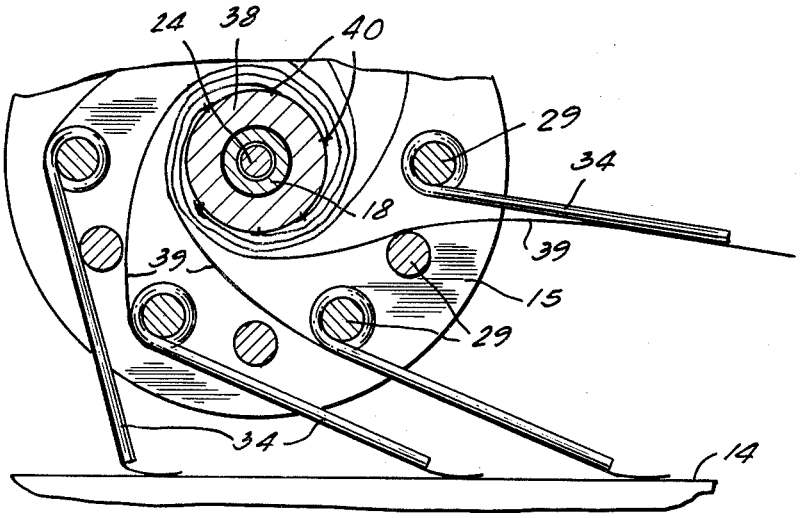
FIG. 5 is a view similar to FIG. 4 but showing the sanding strips extended as flexible working elements.
Figure 6:
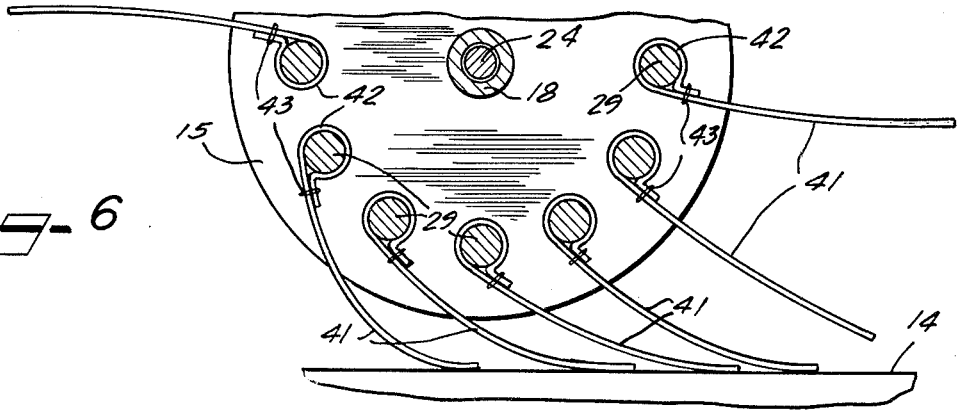
FIG. 6 is a view similar to FIG. 4 but showing the tool equipped with flexible sanding or polishing strip flexible working elements mounted on the supporting shafts of the tool.

For fine finishing or polishing, means in the form of a roll 37 of strip finishing material carrying suitable abrasive means, such as sandpaper or emery cloth and the like, is adapted to be mounted in the tool about the hub 18. For this purpose, the roll 37 has a tubular core 38 which may be of wood or the like and a suitable number of strips 39 of about the same width as the length of the spool or core 38 are secured, such as by means of staples or tacks 40 (FIG. 5) to the core 38. The strips 39 are wound upon the core in suitable fashion so that, when desired, the strips can be paid out from a wound inactive stored condition as shown in FIG. 4 into an extended condition as shown in FIG. 5 with free end portions of the strips 39 extending outwardly adjacent to and beyond each of the sets of working fingers 34 to provide flexible polishing array of the strip ends to engage and work the surface 14 in the rotation of the tool. Of course, the strips 39 may also be used without backup by the fingers 34. As the free end portions of the strips 39 wear down or wear out, the core 38 can be turned to pay out, additional strip material or the strips can be pulled out to advance fresh free end areas of the strips for working purposes.

To facilitate functioning of the roll 37 for its intended purpose, the core may be slightly longer than the hub 18 so that when the roll 37 has been installed in the tool and the plate 17 returned to the assembly, and the arbor 35 and more particularly the shoulder means 25 tightened against the disk 17, the hub 38 will be held firmly enough to avoid unintended projection of the strips 39, although the retention of the core 38 by and between the disks 15 and 17 may be frictional such as to permit pulling of the strips into working position without necessarily having to loosen the shoulder 25.

If preferred, polishing or sanding strips 41 comprising yieldable working elements adapted to be mounted directly on the shafts 29 may be provided. In such instance the strips 41 are provided with terminal anchoring loops 42 secured as by means of rivets or stitching 43. For example, there may be polishing strips 41 equal in number to the number of the shafts 29 provided and each shaft thereby carrying one of the strips 41.

From the foregoing it will be apparent that the tool 10 comprises a versatile convertible take-apart structure in which the assembly can be readily separated by removal of the arbor 13 whereby the disk 17 readily separates from the assembly. Then any desired arrangement of working elements and/or sanding, polishing strip roll material may be assembled, and the tool readily put together again by returning the disk 17 into the assembly and securing the arbor 13 in place by manipulation of the shoulder collar 25 through the wrench faces 28.

It will be understood that variations and modifications may be effected without departing from the spirit and scope of the novel concepts of this invention.

I claim as my invention:

1. A take-apart convertible rotary tool for working a surface by means of peripherally extending yieldable working elements, comprising:

a pair of spaced coaxial body disks of substantial diameter;

an axial hub of substantially smaller diameter than the disks and having one end permanently fixedly attached in unitary relation to the center of one of said disks, and the opposite end of said hub projecting toward the other disk;

said other disk being separably assembled with said opposite end of said hub;

said hub having a threaded bore opening through said opposite end;

said other disk having a central opening slightly larger than said threaded bore but smaller than the diameter of said other end of said hub;

an arbor adapted to be engaged by a power tool chuck and having a threaded shank projecting axially from a clamping shoulder integral with said arbor and of larger diameter than said shank;

said shank engaging through said central hole in said other disk into threaded engagement in said threaded bore whereby said shoulder clamps said other disk toward said other end of the hub, said arbor being adapted to function as the sole means for securing said other plate to said hub and having peripheral wrench face means adjacent to said shoulder to facilitate threaded manipulation of the arbor for securing the parts of the tool together or for separating the parts of the tool from one another;

a plurality of working element supporting shafts having one of their ends permanently fixedly attached in unitary relation to said one disk at respective spaced intervals relative to each other and relative to said hub and projecting toward said other disk;

said shafts being longer than said hub;

said other disk having socket holes therein complementary in diameter to said shafts;

free ends of said shafts extending freely slidably and freely releasably and without affixation into said sockets for mutual cooperation of said shafts and said other disk so that said shafts maintain said other disk corotative with said one disk and said other disk maintains said free ends of said shafts in stable relation in the assembly and working elements mounted on said shafts will be held against escape;

said other disk being separable from said hub and said shafts by simply detaching said arbor from said hub so that said other disk is then adapted to be freely lifted away from said free ends of said shafts for attaching or removing the working elements relative to said shafts, said other disk being then adapted to be quickly replaced and the arbor shaft rethreaded into said threaded bore of the hub to refasten said other disk and the unit comprising said one disk and the unitarily attached hub and shafts;

a roll of surface finishing material comprising finishing strips secured to a tubular core, said core received about said hub between said disks and inside said shafts, said core being retained between said disks but being rotatable relative to said hub to pay the strips out between said shafts;

and stiff working elements mounted rotatably on said shafts and adapted to serve as primary surface cleaning elements, and also to serve as backing for said strips when the strips are paid out for finishing purposes.

2. A tool according to claim 1, wherein said shoulder comprises a collar on the arbor and the collar has said wrench face means thereon.

3. A tool according to claim 1, wherein said working elements are in the form of wire fingers having looped coils on their proximal ends pivotally engaging said shafts and providing spacers between the adjacent fingers.

4. A tool according to claim 1, wherein said one end of said hub has a reduced diameter extension and an axially facing shoulder about the extension, said one disk has a central hole through which said extension projects, said extension being longer than the thickness of said one disk, said extension being peened over whereby to rivet said one disk about said central hole permanently against said shoulder, and each of said shafts having a reduced diameter base end portion which extends through a respective complementary hole in said one disk and rivet heads peened over on said base end portions and thereby permanently rivetting the shafts in place on said one disk.

5. A combination take-apart convertible rotary tool for working a surface by means of peripherally extending yieldable working elements, comprising:

a pair of spaced coaxial body disks of substantial diameter;

an axial hub of substantially smaller diameter than the disks fixedly mounted on one of said disks and projecting toward the other disk, said hub having a threaded bore opening through its end adjacent to said other disk;

said other disk having a central opening slightly larger than said threaded bore but smaller than the diameter of said adjacent end of said hub;

an arbor adapted to be engaged by a power tool chuck and having a threaded shank projecting axially from a clamping shoulder and engaging through said central hole in said other disk into threaded engagement in said threaded bore whereby said shoulder clamps said other disk toward said adjacent end of the hub, said arbor having peripheral wrench face means adjacent to said shoulder to facilitate threaded manipulation of the arbor for securing the parts of the tool together or for separating the parts of the tool;

a plurality of working element supporting shafts fixedly mounted on said one disk at spaced intervals relative to each other and relative to said hub and projecting toward said other disk, said shafts being longer than said hub;

said other disk having socket holes therein complementary in diameter to said shafts and having free ends of said shafts extending thereinto for mutual cooperation of said shafts and said other disk whereby the shafts maintain said other disk corotative with said one disk and said other disk maintains said free ends of said shafts in stable relation in the assembly;

a roll of surface finishing material comprising finishing strips secured to a tubular core, said core received about said hub between said disks and inside said shafts, said core being retained between said disks but being selectively rotatable relative to said hub to pay the strips out between said shafts;

and stiff working elements mounted rotatably on said shafts and adapted to serve as primary surface cleaning elements, and also to serve as backing for said strips when the strips are paid out for finishing purposes.

6. A tool according to claim 5, wherein said working elements are in the form of wire fingers having looped coils on their proximal ends pivotally engaging said shafts and providing spacers between the adjacent fingers.

7. A take-apart convertible rotary tool for working a surface by means of peripherally extending yieldable working elements, comprising:

a pair of spaced coaxial body disks of substantial diameter;

an axial hub of substantially smaller diameter than the disks fixedly mounted on one of said disks and projecting toward the other disk, said hub having a threaded bore opening through its end adjacent to said other disk;

said other disk having a central opening slightly larger then said threaded bore but smaller than the diameter of said adjacent end of said hub;

an arbor adapted to be engaged by a power tool chuck and having a threaded shank projecting axially from a clamping shoulder and engaging through said central hole in said other disk into threaded engagement in said threaded bore whereby said shoulder clamps said other disk toward said adjacent end of the hub, said arbor having peripheral wrench face means adjacent to said shoulder to facilitate threaded manipulation of the arbor for securing the parts of the tool together or for separating the parts of the tool;

a plurality of working element supporting shafts fixedly mounted on said one disk at spaced intervals relative to each other and relative to said hub and projecting toward said other disk, said shafts being longer than said hub;

said other disk having socket holes therein complementary in diameter to said shafts and having free ends of said shafts extending thereinto for mutual cooperation of said shafts and said other disk whereby the shafts maintain said other disk corotative with said one disk and said other disk maintains said free ends of said shafts in stable relation in the assembly;

and a plurality of working elements supported on said supporting shafts, said working elements comprising a combination of relatively stiff working elements mounted rotatably on said shafts and adapted to serve as primary surface cleaning elements, and relatively flexible working elements mounted on a spool rotatably mounted on said hub between said disks so as to enable extension of said flexible elements from inside said shafts and beyond said stiff working elements, whereby said flexible elements are adapted to serve as finishing surface cleaning elements.

8. A take-apart convertible rotary tool for working a surface by means of peripherally extending yieldable working elements, comprising:

a pair of spaced coaxial body disks of substantial diameter;

an axial hub of substantially smaller diameter than the disks and having one end permanently fixedly attached in unitary relation to the center of one of said disks, and the opposite end of said hub projecting toward the other disk;

said other disk being separably assembled with said opposite end of said hub;

said hub having a threaded bore opening through said opposite end;

said other disk having a central opening slightly larger than said threaded bore but smaller than the diameter of said other end of said hub;

an arbor adapted to be engaged by a power tool chuck and having a threaded shank projecting axially from a clamping shoulder integral with said arbor and of larger diameter than said shank;

said shank engaging through said central hole in said other disk into threaded engagement in said threaded bore whereby said shoulder clamps said other disk toward said other end of the hub, said arbor being adapted to function as the sole means for securing said other plate to said hub and having peripheral wrench face means adjacent to said shoulder to facilitate threaded manipulation of the arbor for securing the parts of the tool together or for separating the parts of the tool from one another;

a plurality of working element supporting shafts having one of their ends permanently fixedly attached in unitary relation to said one disk at respective spaced intervals relative to each other and relative to said hub and projecting toward said other disk;

said shafts being longer than said hub;

said other disk having socket holes therein complementary in diameter to said shafts;

and a plurality of working elements supported by said tool, said working elements comprising a combination of relatively stiff working elements mounted rotatably on said shafts and adapted to serve as primary surface cleaning elements, and relatively flexible working elements mounted on a spool rotatably mounted on said hub between said disks so as to enable extension of said flexible elements from inside said shafts and beyond said stiff working elements, whereby said flexible elements are adapted to serve as finishing surface cleaning elements.

* * * * *